United States Patent [19]

Whitly

[11] Patent Number: 4,471,877

[45] Date of Patent: Sep. 18, 1984

[54] CRANE SENSOR TO DETECT OUT OF PLUMB LIFT CABLE

[76] Inventor: Charles C. Whitly, 106 Wicklow Blvd., New Iberia, La. 70560

[21] Appl. No.: 413,761

[22] Filed: Sep. 1, 1982

[51] Int. Cl.[3] ..... B66C 19/00

[52] U.S. Cl. ..... 212/153; 200/47; 212/147

[58] Field of Search ..... 212/147, 149, 151, 153, 212/154; 340/685, 689; 200/61.48, 47, 161

[56] References Cited

U.S. PATENT DOCUMENTS

| | | | |
|---|---|---|---|
| 1,857,172 | 5/1932 | Wagner | 212/149 |
| 2,195,692 | 4/1940 | Bushey | 200/161 |
| 2,346,066 | 4/1944 | Conrad | 340/685 |
| 2,916,162 | 12/1959 | Gercke | 212/147 |
| 3,218,624 | 11/1965 | Zane | 340/689 |
| 3,826,380 | 7/1974 | Lenander et al. | 212/153 |
| 4,273,243 | 6/1981 | Locker | 212/153 |

FOREIGN PATENT DOCUMENTS 2220994 11/1973 Fed. Rep. of Germany ..... 212/149

*Primary Examiner*—Trygve M. Blix
*Assistant Examiner*—Stephen P. Avila
*Attorney, Agent, or Firm*—Emory L. Groff, Jr.

[57] ABSTRACT

A sensor assembly on a crane apparatus includes a multi-pole switch such as a wobble switch mounted adjacent the head of a crane boom. The switch is carried by a pendulum arm and is activated by an actuating member engageable by the crane lift cable whenever the cable is out of plumb. Activation of any one of the switch contacts completes a specific circuit to illuminate a particular signal element in the crane cab thereby advising the operator in which of four directions the lift cable is out of plumb so the crane may be manipulated to obtain a plumb relationship prior to lifting of a load.

8 Claims, 11 Drawing Figures

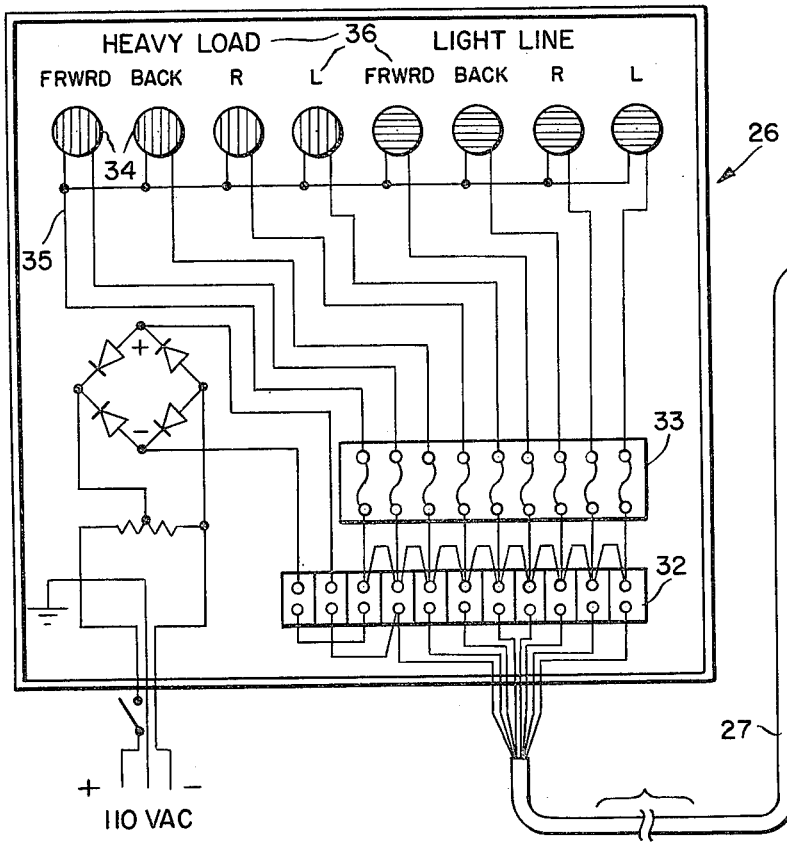
FIG. 1.
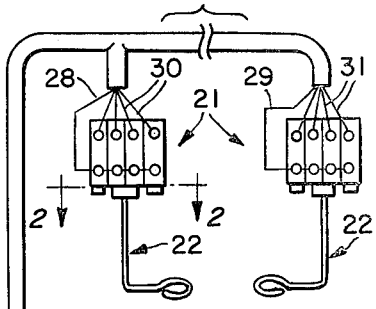
FIG. 7.
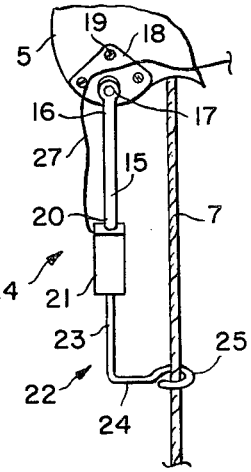
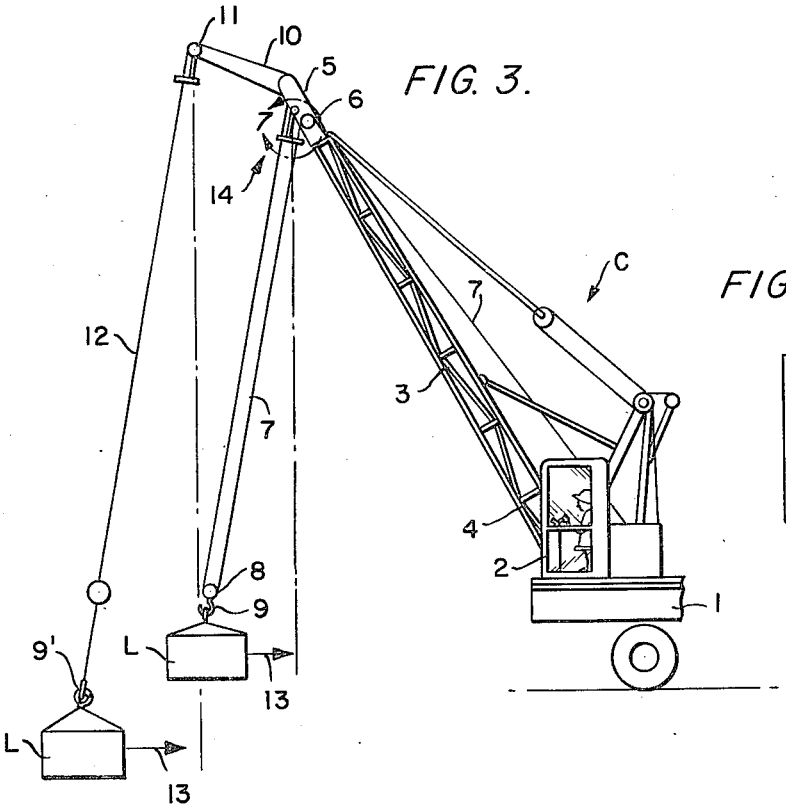
FIG. 3.
FIG. 3A.
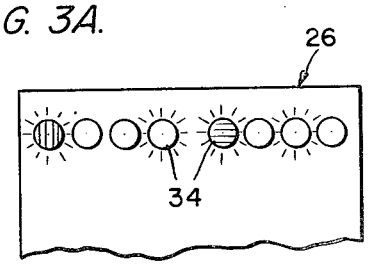
FIG. 2.
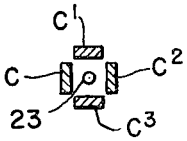

CRANE SENSOR TO DETECT OUT OF PLUMB LIFT CABLE

This invention relates generally to lifting apparatus such as cranes or derricks and more particularly, to an improved sensing apparatus enabling the operator instantly to become aware whenever the lifting cable is out of plumb with respect to an engaged load ready to be hoisted.

Warning devices to signal or to correct an un-safe operating condition in the use of lifting mechanisms are well known. One such dangerous condition involves extending the crane boom head to an excessive radius for the load at hand whereupon either the power train and associated components would be overloaded, or more critically, the concerned load could cause the crane to be overturned.

U.S. Pat. No. 2,346,066 issued Apr. 4, 1944 to Conrad discloses an example of a crane apparatus which signals the operator when an unsafe radius/load situation exists. U.S. Pat. No. 2,916,162 issued Dec. 8, 1959 to Gercke illustrates control means for assisting in overcoming another common crane condition, namely pendulum motions of a hoisted load and wherein, compensating instructions are automatically delivered to the crane motors to dampen the hoisted load oscillations.

The safety mechanism of the present invention serves to prevent a crane operator from lifting a load from its at-rest position when the lift cable pulley in the boom head is not directly overhead the load lift point. In other words, by means of the present device, the crane operator will be made aware whenever an attached lift cable is out of plumb so that when hoisting of a load commences, the load will not automatically horizontally swing toward the direction of an off-center crane head with the possibility of striking and injuring a member of the loading or unloading crew.

Crane operators with many years of experience are usually highly proficient in spotting the crane boom head generally over a load to be hoisted but after attachment of the lift cable hook to the load point and slack is taken up in the lift cable, the lift cable is quite often out of plumb by at least several inches. Such a situation leads to an unsafe condition with the result that when the load is lifted, it suddenly horizontally swings toward the direction of the out of plumb crane boom head. The difficulty of accurately visually spotting the crane boom head is magnified when the boom is extremely long and/or elevated to a high angle and is further compounded when there is a noticeable prevailing wind. Additionally, when the intended load is out of view by the operator, such as in a ship's hold, he must rely solely upon instructions of a signalman or a spotter with the result that few pick-ups can be made with a plumb lift cable. The force of any sudden horizontal swinging of the lifted load will depend not only upon the degree of mis-alignment between the crane boom head and load lift point but also upon the weight and configuration of the load and the prevailing wind. The problem is particularly evident in the operation of offshore cranes which often are employed to offload equipment from an unsecured boat located 100–150 feet below the operator. With the instant arrangement, a notable degree of safety is added to the operation of any lifting apparatus involving a horizntal moving boom or hoisting pulley including pedestal, gantry and overhead traveling cranes.

Accordingly, one of the objects of the present invention is to provide an improved crane sensor adapted to detect an out of plumb lift cable after its attachment to an intended load and which includes a signal unit visible to the operator for instantly indicating in which direction the boom head is out of plumb with respect to the attached load.

Another object of the present invention is to provide an improved crane sensor for detecting an out of plumb lift cable including a pendulum-mounted multi-pole switch suspended near the free end of the crane boom and containing actuating means deflectable whenever the lift cable is out of plumb.

Still another object of the present invention is to provide an improved crane sensor for detecting an out of plumb lift cable and including a four-way wobble switch pivotally mounted normally to maintain a constant plumb relationship with the upper portion of a lift cable regardless of the elevation of the crane boom.

A further object of the present invention is to provide an improved crane sensor for detecting an out of plumb lift cable including a pendulum-mounted four-way wobble switch mounted to maintain a constant plumb relationship with the upper portion of the lift cable and provided with a deflectable actuating member having an engageable element constantly encirculing the lift cable.

With these and other objects in view which will more readily appear as the nature of the invention is better understood, the invention consists of the novel construction, combination and arrangement of parts hereinafter more fully described, illustrated and claimed.

FIG. 1 is a diagrammatic view of the switches, electrical circuit and signalling components of the present invention;

FIG. 2 is a horizontal sectional view, taken along the line 2—2 of FIG. 1;

FIG. 3 is a side elevation illustrating an out of plumb condition with load lift points disposed forward of the plumb line;

FIG. 3A is a diagrammatic view of the panel unit of FIG. 1 as the signal lights would appear during the conditions of FIG. 3;

FIG. 7 is an enlarged perspective view of the encircled portion of FIG. 3 and illustrates the details of the sensor assembly carried by the crane boom head.

Similar reference numerals designate corresponding parts throughout the several figures of the drawings.

Figure 4:
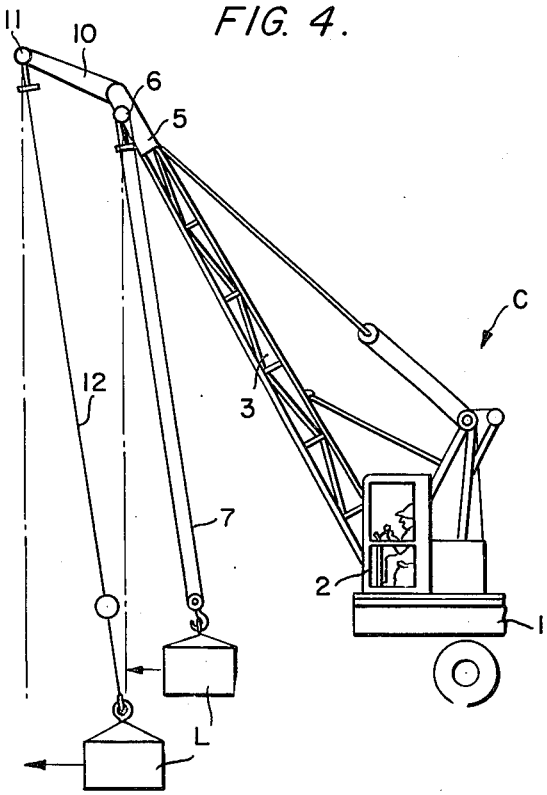
FIG. 4 is a view similar to FIG. 3 and illustrates a condition when the load lift points are disposed to the rear of the plumb line.
Figure 5:
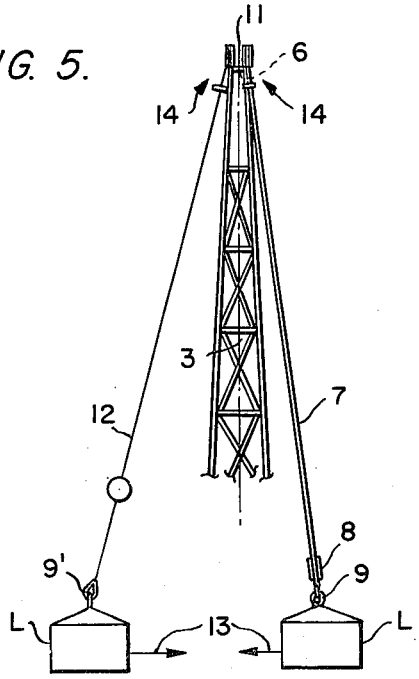
FIG. 5 is a front elevation illustrating alternative conditions with respective load-engaging lift cables located to the left and right of the plumb line with respect to the crane operator.
Figure 6:
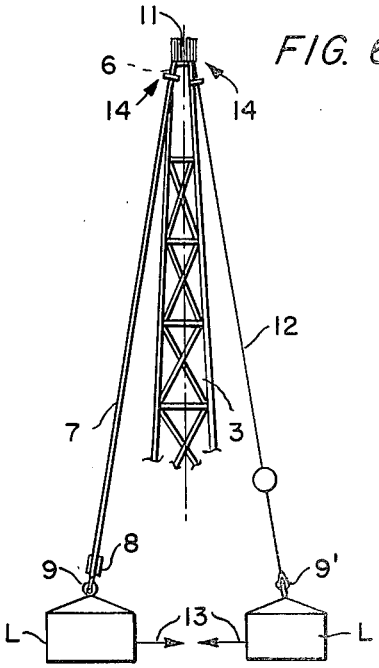
FIG. 6 is a view similar to FIG. 5 and illustrates a reversal of the two different lift cables of FIG. 5 and respective out of plumb situations.

Referring now to the drawings, particularly FIGS. 3–6, the present invention will be seen to relate to a sensor apparatus particularly adapted for use with hoisting devices such as the crane, generally designated C. The specifically illustrated crane C will be understood to be merely exemplary of an appropriate crane or derrick structure with which the present invention may be used since the present sensor will find application in any type of hoisting device wherein the lift cable is sheaved about a pulley that is adapted to be horizontally and/or arcuately spotted over an intended load. The crane C shown in the drawings includes a relatively stationary base 1 atop which is a rotatable cab 2 containing the usual operator controls, motors, gears, cable drums etc. A jib or main boom 3 having its lower end 4 suitably pivotally attached to the cab 2, is provided with a boom head 5 at its opposite end. The boom head 5 includes a pulley 6 journaled along a horizontal axis and about which a lift cable 7 is sheaved. This lift cable will be seen to pass from the cab 2, around the pulley 6 and thence downwardly to a suitable block 8 associated with a load hook 9 after which the lift cable is returned to the boom head where it is appropriately anchored.

The lift cable 7 as above described comprises the heavy load line. The depicted crane C will be seen to additionally include a top lift 10 extending beyond the main boom head 5 and which includes a light load pulley 11 about which passes a single fast line or light load lift cable 12 terminating in a load hook 9'.

In each of the FIGS. 3–6 of the drawings, both the heavy load line 7 and single fast line 12 are illustrated with their respective load hooks 9,9' engaging a load L. Quite obviously, both lift cables will not be simultaneously utilized to hoist two different loads and the illustration of both engaged lift cables in these drawing figures will serve to graphically illustrate the unsafe condition which the apparatus of this invention is intended to identify and correct, regardless of which of the two lift cables a crane operator is employing. In each instance, arrows 13 reflect the direction of horizontal displacement of each respective load L should the operator initiate hoisting of the attached cable 7 or 12 with the out of plumb relationship existing between the attached load hook and cable pulley 6 or 11.

Accordingly, it will be appreciated that suitable apparatus for detecting the out of plumb relationship shown in FIGS. 3–6 would be highly desirable in any hoisting device since the horizontal shifting of a lifted load presents an extremely dangerous situation for the members of the associated work crew not to mention the possible damage to the contents of the load should it be swung into an immobile object. As will be seen most clearly in the enlarged view of FIG. 7 of the drawings, a sensor assembly 14 is mounted adjacent each cable pulley 6 and 11. Each sensor assembly 14 includes a pendulum arm 15 having an apertured upper end 16 supported by a pivot shaft 17 carried by the mounting plate 18. Suitable fasteners 19 fixedly attach the mounting plate 18 to the crane structure at a point immediately laterally adjacent that area wherein the respective lift cable 7 or 12 depends from the related cable pulley 6 or 11.

Supported upon the lower end 20 of each pendulum arm 15 is a 4-wayswitch 21. This switch will be understood to be any suitable type such as a wobble or joy stick switch mechanism containing four sets of normally open contacts equally spaced in four directions or quadrants with these contacts respectively aligned to the left and right and forward of and rearward relative the adjacent stretch of the lift cable 7 or 12. Associated with each 4-way switch 21 is an actuating member 22 comprising a stiff yet resilient member extending from a point intermediate the four sets of contacts c, $c^1$, $c^2$, $c^3$ in the switch 21 downwardly to form a depending section 23 and which extends as an off-set section 24 projecting laterally toward the adjacent lift cable. The actuating member terminates in a cable engageable element 25 preferably comprising a circular formation completely surrounding the adjacent stretch of the lift cable but without any contact between the cable engageable element and the lift cable when the lift cable is in a plumb disposition. With the lift cable plumb, the foregoing described relationship is insured due to the configuration of the actuating member 22 and the natural disposition of the attached pendulum arm 15 such that at any time when the lift cable is disposed in an out of plumb relationship between its load hook 9,9' and respective pulley 6,11 it will be understood that the lift cable will contact the cable engageable element 25 and deflect same thereby closing a contact c, $c^1$, $c^2$ or $c^3$ within the attached switch 21.

The occurrence of such a relationship as described above is transmitted to a signal panel or unit 26 located within the crane cab 2 in full view of the operator. This unit and its relationship to the sensor assembly 14 mounted on the boom 3 and top lift 10 is shown in detail in FIG. 1 of the drawings and will be seen to be tied into the two sensor assemblies 14 by means of a multi-conductor electric line 27. This electric line includes common wires 28 and 29 leading to one side of all contacts in each switch 21 as well as four individual activating circuit wires 30 and 31 leading respectively to the other side of each of the four contacts in each switch 21. The other ends of these wires lead to the panel unit 26 which is shown as receiving its power from an AC source but quite obviously, an alternate DC battery source may be employed without departing from the scope of this invention.

Figure 4A:
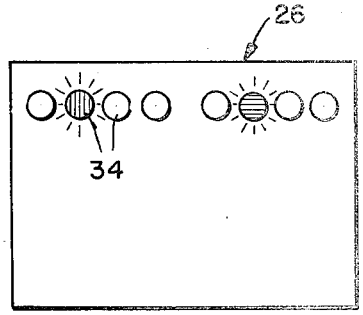
FIG. 4A is a diagrammatic view of the panel unit of FIG. 1 as the signal lights would appear during the conditions of FIG. 4.
Figure 5A:
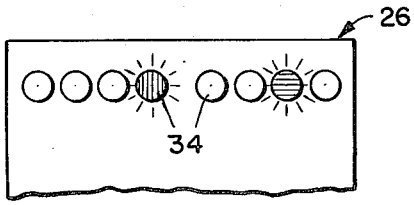
FIG. 5A is a diagrammatic view of the panel unit of FIG. 1 as the signal lights would appear during the conditions of FIG. 5.
Figure 6A:
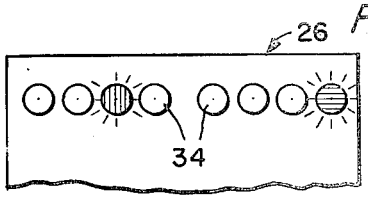
FIG. 6A is a diagrammatic view of the panel unit of FIG. 1 as the signal lights would appear during the conditions of FIG. 6.

The incoming wires from the electric line 27 are attached to a suitable terminal board 32 in the panel unit 26 and from there the individual activating circuit wires from the eight contacts of the two switches 21 pass through a fuse block 33 and lead to appropriate warning or signal elements 34 such as the eight bulbs shown in the drawings. The other side of the circuit intended to illuminate the individual bulbs 34 is supplied by the common wire 35 whereupon it will be realized that upon the closing of any contact c, $c^1$, $c^2$ or $c^3$ of either one of the switches 21, a bulb 34 will be illuminated and instantly signals to the operator that an out of plumb condition exists. Appropriate indicia 36 associated with each of the signal elements or bulbs 34 readily identifies which switch contact has been activated and accordingly, in which direction an attached load projects out of plumb with respect to the associated cable pulley 6 or 11. Additionally, to differentiate between the sensor mechanisms associated with the two lift cables 7 and 12, it is proposed that the signal elements 34 activated by one of the sensor assemblies 14 be of a different color than those activated by the second one of the sensor assemblies. Thus, those four bulbs controlled by the sensor assembly adjacent the heavy load line 7 may be red, for example, while the remaining four bulbs controlled by the sensor assembly adjacent the light load line 12 may be blue. The various drawing FIGS. 3A, 4A, 5A and 6A depict the illumination of particular bulbs 34 specifically identifying the out of plumb situation shown in FIGS. 3, 4, 5 and 6 respectively.

The operator, upon viewing an illuminated signal element 34 is immediately apprised of an un-safe condition and is able to readily correct the situation by manipulation of the crane controls to swing, raise or lower the boom until the particular signal element is no longer activated, at which time the lift cable will be plumb and the load may be safely hoisted. In addition to the visual signal elements 34, suitable audible means (not shown) may be included to alert the operator of out of plumb conditions thereby reducing the amount of scanning of the panel unit 26 by the operator.

I claim:

1. A safety device for hoisting apparatus of the type having a pivoted elevated boom mounted for rotary slewing and vertical jib motion, said safety device adapted to indicate an out of plumb lift cable as attached to a load comprising, said boom having a head, a pulley carried by said head, a powered lift cable sheaved about said pulley, said lift cable having a lowermost portion provided with attachment means adapted to engage a load, a sensor assembly attached adjacent said pulley, said sensor assembly including a single pendulum arm suspended from said boom head adjacent said lift cable, a multi-pole switch carried by said pendulum arm, a deflectable switch actuating member extending from said switch and provided with a unitary lift cable engageable element substantially encircling said lift cable, said pendulum arm including an upper end pivotally attached to said boom head to allow swinging of said arm solely in the tilting plane of said boom during vertical jib motion, normal pendulum action of said arm maintaining said cable engageable element in a substantially non-biasing relationship with respect to said lift cable as encircled therewithin when said lift cable is plumb, a panel unit observable by the operator of said hoisting apparatus, activatable signal means in said panel unit, and electrical circuit means joining said multi-pole switch and signal means whereby, upon engagement between said cable attachment means and a load with said lift cable out of plumb, said switch actuating member cable engageable element is radially deflected by the encircled lift cable to activate said switch and a portion of said circuit means and said signal means to indicate to the operator in which direction said boom head is out of plumb relative to the attached load.

2. A safety device for hoisting apparatus according to claim 1 including, a top lift extending from said boom head and having a pulley thereon, a powered light load lift cable sheaved about said top lift pulley, another said sensor assembly disposed adjacent said top lift pulley with its switch actuating member cable engageable element encircling said light load lift cable.

3. A safety device for hoisting apparatus according to claim 2 wherein, said multi-pole switches each comprise a 4-way wobble-type switch angularly oriented relative the longitudinal axis of said boom whereby, upon actuation of one said switch by one said lift cable said signal means indicates the boom head is forward, rearward, right or left of a plumb line to the attached load.

4. A safety device for hoisting apparatus according to claim 1 wherein, said multi-pole switch comprises a 4-way wobble-type switch angularly oriented relative the longitudinal axis of said boom whereby, upon activation of said switch said signal means indicates said boom head is forward, rearward, right or left of a plumb line to the attached load.

5. A safety device for hoisting apparatus according to claim 1, wherein, said deflectable switch actuating member comprises an elongated wire-like resilient member including a depending section extending from said switch, an offset section extending from said depending section, and said cable engageable element encircling said lift cable attached to said offset section.

6. A safety device for hoisting apparatus according to claim 1 wherein, said switch includes a plurality of normally open contacts radially spaced around said activating member and each said contact joined by said circuit means to one said signal means.

7. A safety device for hoisting apparatus according to claim 1 wherein, said signal means comprises a plurality of light bulbs each joined by said circuit means to one pole of said switch.

8. A safety device for hoisting apparatus according to claim 1 wherein, said arm includes a lower end and said switch mounted upon said arm lower end with said actuating member disposed well spaced beneath said pulley.

* * * * *

UNITED STATES PATENT AND TRADEMARK OFFICE

CERTIFICATE OF CORRECTION

PATENT NO. : 4,471,877

DATED : September 18, 1984

INVENTOR(S) : Charles C. Whitley

It is certified that error appears in the above-identified patent and that said Letters Patent is hereby corrected as shown below:

On the title page Inventor should read

--(76) Inventor: Charles C. Whitley --.

Signed and Sealed this

*Tenth* Day of *June 1986*

[SEAL]

*Attest:*

DONALD J. QUIGG

*Attesting Officer*

*Commissioner of Patents and Trademarks*